United States Patent [19]

Comer

[11] 4,029,822

[45] June 14, 1977

[54] BONE END SHIELD FOR MEAT CUTS

[76] Inventor: Robert E. Comer, 2425 25th Ave., Greeley, Colo. 80631

[22] Filed: Dec. 29, 1975

[21] Appl. No.: 644,628

[52] U.S. Cl. ..... 426/124; 206/497; 206/521; 229/2.5 R; 426/129

[51] Int. Cl.[2] ..... B65B 25/06

[58] Field of Search ..... 206/521, 497, 45.33; 229/2.5; 426/124, 129, 106, 396, 132, 392

[56] References Cited

UNITED STATES PATENTS

| | | | |
|---|---|---|---|
| 2,891,870 | 6/1959 | Selby et al. | 426/124 |
| 2,918,379 | 12/1959 | Lurie | 229/2.5 |
| 3,018,015 | 1/1962 | Abriss et al. | 206/521 X |
| 3,218,178 | 11/1965 | Pava | 206/521 X |
| 3,253,762 | 5/1966 | Gaunt | 229/2.5 |
| 3,264,120 | 8/1966 | Westcott | 229/2.5 |
| 3,438,507 | 4/1969 | Kreuger | 426/129 X |
| 3,580,413 | 5/1971 | Quackenbush | 229/2.5 |
| 3,653,927 | 4/1972 | Howell et al. | 426/124 X |
| 3,740,238 | 6/1973 | Graham | 206/45.33 X |
| 3,876,812 | 4/1975 | Peters | 206/521 X |
| 3,955,040 | 5/1976 | Schirmer | 426/129 X |

*Primary Examiner*—Steven L. Weinstein
*Attorney, Agent, or Firm*—Edwin L. Spangler, Jr.

[57] ABSTRACT

This invention relates to a pre-formed essentially puncture-proof pliable plastic shield shaped to cover the exposed bone ends in a cut of fresh meat preparatory to encasing same in an evacuated bag which is characterized by a marginal skirt that effectively holds the shield in place while completing the packaging operation, a series of spaced pleats around the edge of the skirt that permit the latter to fold in snug against the adjacent edge of the meat cut when drawn inwardly by the collapsing bag as well as expand both endwise and lengthwise to accommodate oversize cuts, systems of preformed corrugations between the pleats that define channels operative to carry the juices into the areas of greatest potential stress, a plurality of pockets overlying the bone ends effective to trap the fluids squeezed from the meat and produce fluid-filled cushions, dome-like crush-resistant dimples in the corners adjacent the thick edge of the cut subjected to the greatest abuse, and ribbed surfaces covering the boneless tissue.

10 Claims, 11 Drawing Figures

BONE END SHIELD FOR MEAT CUTS

The meat processing industry is continually confronted with the problem of trying to find better and cheaper ways of preserving meat for a longer period of time after the animal is butchered so that the wholesaler or dealer, as the case may be, can move the meat into the channels of distribution under the most favorable market conditions. With the introduction of vacuum packaging of meat cuts many years ago, the necessity for freezing the meat to preserve it was no longer necessary except in rare circumstances because it could be kept fresh quite satisfactorily until sold by merely storing it under refrigerated conditions. The key to the success of this method of preservation was the ability to produce and maintain a vacuum inside the package for as long as the meat remained in storage. Unfortunately, there are several cuts of meat, expecially the larger packing house cuts that are sold to the butcher rather than directly to the consumer that have proved to be very difficult to vacuum pack effectively. These cuts are those that have exposed bone ends such as, for example, those cuts known in the trade as "bone in ribs" and "Eastern style chucks" among others. Cuts of meat such as these generally weigh out at about 20 lbs. or more and can run as high as 60–80 lbs. The problem is one of the exposed bone ends puncturing the bag in which the meat is vacuum packed thus causing a so-called "leaker" which must be marketed much sooner than those cuts in which the vacuum pack has maintained its integrity. The options open to the wholesaler or dealer in terms of marketing his product at the most opportune times are, of course, diminished considerably and may be lost altogether with a leaker.

Leakers result in many ways, most of which can be traced to rough handling; however, some develop under static conditions in the storage cooler where the additional shrinkage of the bag that occurs under refrigerated conditions causes leaks to develop in what was formerly a vacuum-tight package. Even so, most ruptures occur during the packaging operation itself, on the conveyor lines where the packages bump against one another or some obstruction in their path, or while the packages are being boxed, loaded, shipped, unloaded and transferred to storage.

The obvious solutions to the problem seemed to be to cover the exposed bone ends with some kind of protective shield that would prevent their puncturing the bag or, alternatively, packaging the meat in a stouter bag. As far as the latter solution was concerned, bags of heavy enough stock to resist puncturing from the inside were so expensive that the packaging cost became prohibitive. Also, no matter how heavy walled the bag was, it offered little resistance to external impact and abrasion. All things considered, the protective shield held more promise of being the answer to the leaker problem and, while it has proven to be far less expensive, it is not even close to becoming a satisfactory solution when as many as four out of five packages of certain cuts of meat are still found to be leakers by the time they reach their destination in the dealer's cooler. Faced with odds like these, many attempts have been made in the past to develop a good protective shield, all with a noteworthy lack of success.

Flat sheets of relatively heavy gauge plastic and wax board, for instance, have been tried many times but have just not worked out. The material cost becomes excessive when heavy enough stock to be puncture-proof is used. Even more disturbing is the inability to keep such shields in place covering the exposed bone ends while placing them and the meat cut in the bag and drawing the vacuum on the latter.

Sheets of styrofoam up to a quarter inch thick and more have also been tried without success. The orientation problem was even worse than with other types of plastic sheeting that is denser and, therefore, heavier, than a corresponding sheet of styrofoam. Also, the styrofoam offered minimal puncture resistance and broke up easily when the bag collapsed thereagainst thus presenting an unsightly appearance. Furthermore, styrofoam being opaque hid the meat from view and was a sales deterent for this reason.

By no means a satisfactory solution to the problem but, nonetheless, the best one found so far, has been to cover the exposed bone ends with a wax-impregnated loosely-woven cloth which is both pliable and puncture resistant. This cloth is generally used in sheets cut approximately 18 × 24 inches out of 0.015 mil. stock. It is laid over the face of the cut having the exposed bone ends and an attempt made to fold it down over the sides and ends so as to keep it in place while the meat is placed in the bag and the latter evacuated and sealed. Keeping the shield in the proper position is a major problem and its failure to stay in place is one prime cause of the leakers. While the opacity of the sheet has nothing to do with the leaker problem, it does hide the meat and is, therefore, bad from an aesthetic standpoint. The seriousness of the leaker problem can, perhaps, be better appreciated if one realizes that in an ordinary packaging run it is not uncommon to find 6–10% leakers at the end of the packaging line before the packages are even boxed. Then, after being boxed, say three to a box, and refrigerated in a cooler for 16 hours, the leaker rate goes up to around 40%. Finally, upon arrival at the ultimate destination after being loaded, jostled around during shipment, unloaded and stored, the leaker rate runs up around 60 to 80% Admittedly, more careful handling can effect substantial reductions in these figures; however, to expect this kind of care to be taken day in and day out is completely unrealistic.

It has now been found in accordance with the teaching of the instant invention that these and other shortcomings of the prior art protective shields for meat cuts having exposed bone ends can, in large measure, be overcome by the simple, yet unobvious, expedient of covering one face of the cut with a specially designed molded plastic shield that is roughly contoured to receive the cut and stay in place thereon while it is inserted into the bag and the latter is evacuated and sealed. The special contour is also such that it will accommodate both right and left-hand cuts equally well.

A downturned skirt borders the shield and provides the means for holding it in place while performing certain other important functions. This skirt is preferably both pleated and corrugated, the pleats providing for lengthwise and endwise expansion to accommodate different size cuts. They also allow the shield to fold and be drawn inward tightly against the surface of the cut of meat the shield is protecting. The corrugations, on the other hand, provide both the normal cushioning action and, in addition, they define channels within which the blood and other fluids known as "purge" are temporarily retained to produce fluid-filled cushions. These same corrugations function to carry the purge into critical areas over the exposed bone ends, along the edges, and especially into the corners where it is trapped in crush-resistant dome-like dimples provided for this purpose. Integrally-formed dams in certain strategically located channels function to restrict the flow of purge and tend to trap it when its cushioning effect is most needed.

It has also been discovered that by selectively cooling the die over which the shield is vacuum formed in the areas along the edges where blows are most likely to occur, these areas will remain essentially the same thickness as the sheet stock from which the shield is formed, whereas, the trough separating the major and minor humps as well as the skirt that basically overlies the soft tissue all will be drawn thin and made quite pliable.

It is, therefore, the principle object of the present invention to provide a novel and improved protective shield for meat cuts having exposed bone ends.

A second object is to provide a unique method for forming the shield wherein the mold over which it is vacuum formed is selectively cooled so that the areas of greatest stress are left essentially the same thickness as the original sheet from which the shield is being formed while the skirt and other areas thereof are drawn thin to make them pliable.

Another object of the invention is to provide a device of the type aforementioned wherein a uniquely designed system of channels and pockets cooperate to direct and trap the juices (purge) squeezed out of the meat so as to form fluid-filled cushions in the areas most likely to be punctured.

Still another objective of the invention herein disclosed and claimed is to provide a molded plastic shield that becomes transparent when sucked into contact with the meat it covers thus presenting an aesthetically attractive package.

An additional objective is to provide a shield of the character described which is formed to stay in place while the meat is being inserted into the plastc bag and while the later is being evacuated and sealed, yet, one that also remains sufficiently pliable to be drawn in snug against the meat under the influence of the collapsing bag.

Further objects are to provide a protective shield for meat cuts having exposed bone ends that is easier and faster to use, puncture resistant, rugged, inexpensive, versatile, safe, clean, reliable and even adaptable to both oversize and undersize cuts while, at the same time, accepting right and left-hand ones with equal facility. Other objects will be in part apparent and in part pointed out specifically hereinafter in connection with the description of the drawings that follows, and in which.

Figure 1:
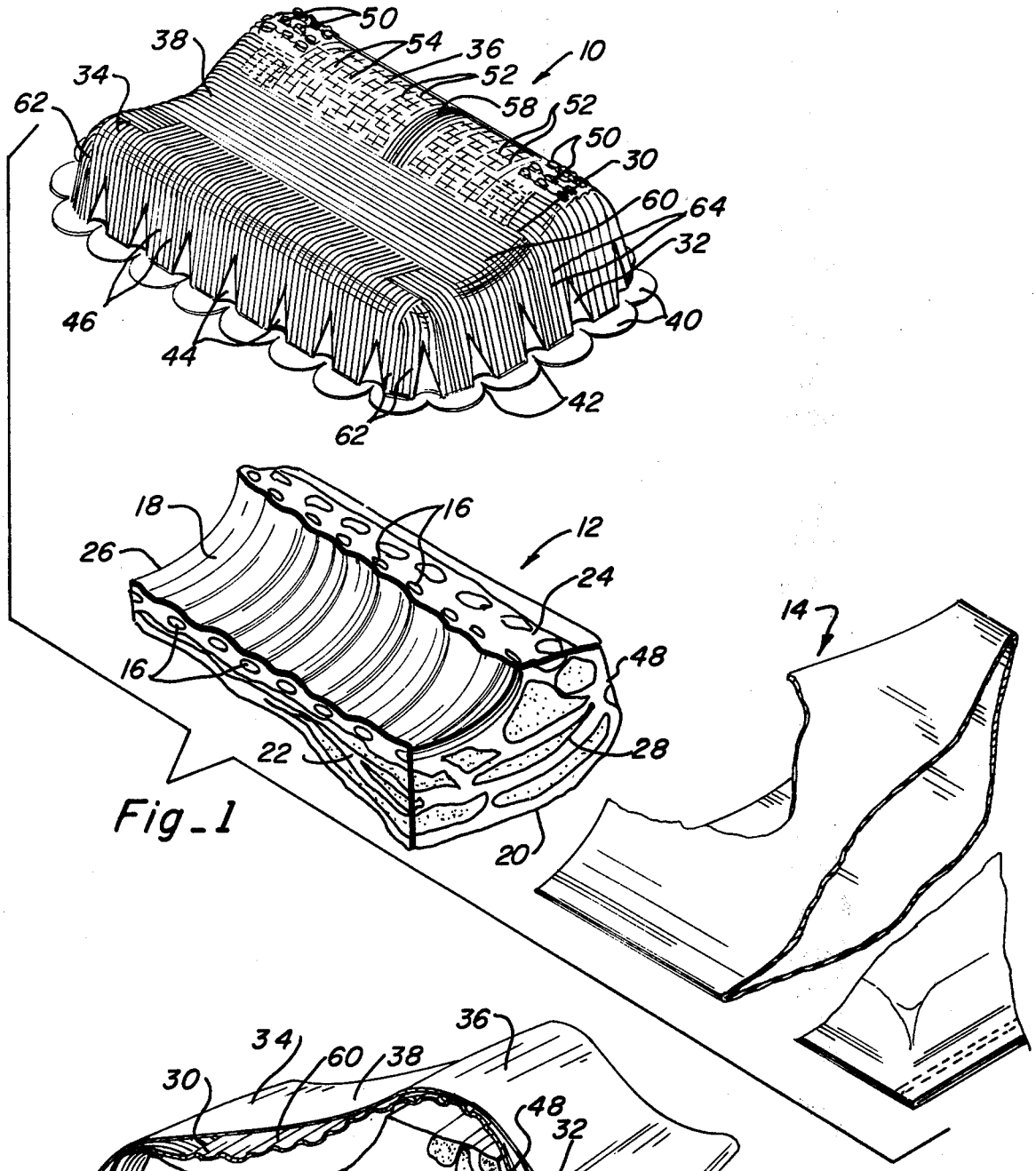
FIG. 1 is an exploded perspective view showing the manner in which the shield is placed down atop the cut of meat so as to cover its exposed bone ends preparatory to placing the subassembly thus formed in a plastic bag, withdrawing the air from the latter and heat sealing it.
Figure 2:
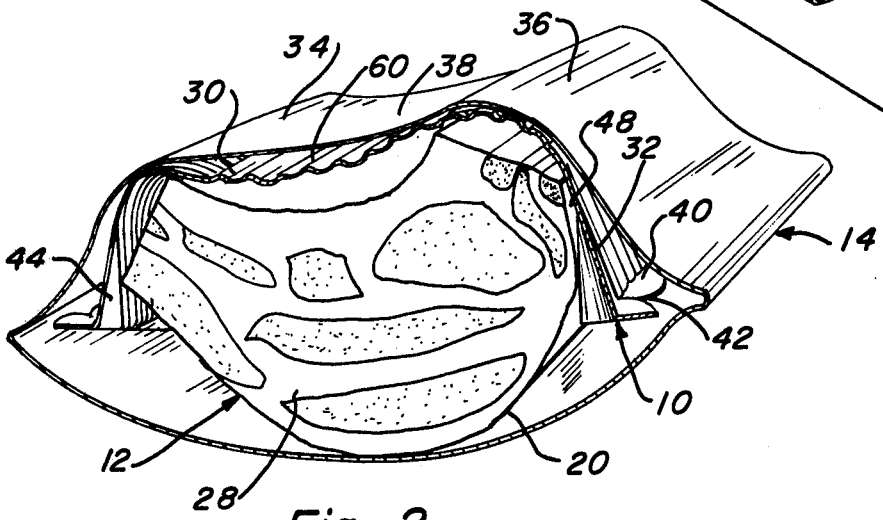
FIG. 2 is a perspective view to a slightly larger scale than FIG. 1 having a substantial portion broken away and shown in section that reveals the package consisting of the meat cut, shield and bag prior to evacuating and sealing the latter.
Figure 3:
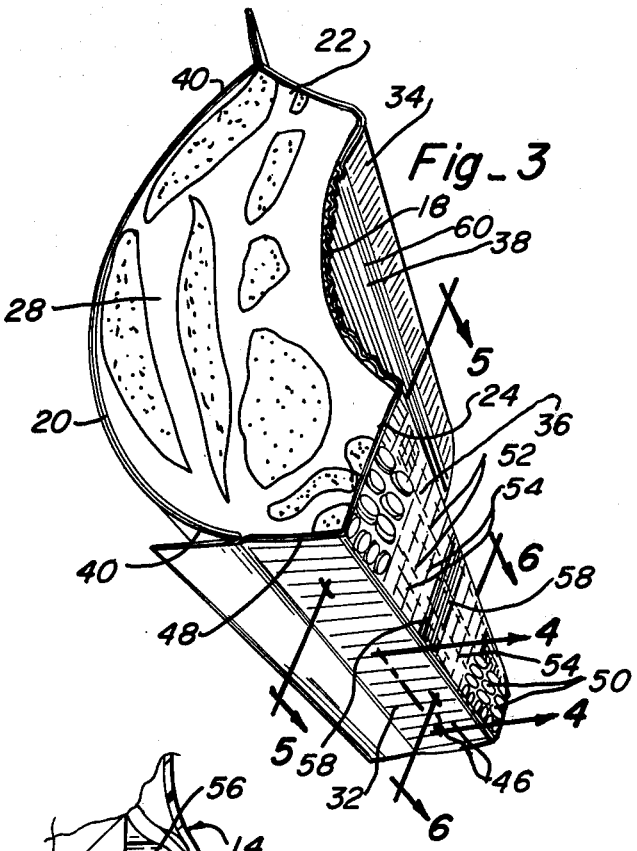
FIG. 3 is a view much like FIG. 2 and to the same scale except that it shows the package after the air has been removed from the bag, the bag sealed, and the package turned up onto its thick edge.

Referring next to the drawings for a detailed description of the present invention and, initially, to FIGS. 1–3 for this purpose, reference numeral 10 has been chosen to designate the shield broadly while numerals 12 and 14 similarly designate the meat cut and bag, respectively. The meat cut 12 is representative of those having exposed bone ends 16 which must be protected in some fashion if they are to be prevented from puncturing the bag 14 and producing a so-called leaker. The particular cut shown is known as bone in ribs and is characterized by a generally concave upper surface 18 defined by the rib cage, the ribs of which lie very near the surface; a convex undersurface 20 produced by a considerable thickness of soft tissue beneath the convex side of the ribs; truncated front and top surfaces 22 and 24 that cut through the ribs at roughly right angles; and, squared off ends 26 and 28. Most cuts of meat are, of course, irregular in shape and they usually are thicker on one side or one end than the other, or both, in the manner of the cut shown. Be that as it may, there is considerable uniformity in the size and shape of the same cuts due to the manner in which beef cattle are raised and "fed out" for today's market. For instance, bone-in-rib cuts like that shown will rarely vary over an inch one way or the other in length and less than one inch in width. Also, the companion cut taken from the opposite side of the animal's body will differ from that illustrated primarily in the respect that end 26 will be the thicker one instead of end 28 when the cut is arranged as shown in FIG. 1. The shield 10 is so designed that it will accommodate either the cut taken from the right side of the animal or the left, the principal difference therebetween being in the relative thicknesses of the ends 26 and 28 which have little influence on the shape of the shield.

Figure 4:
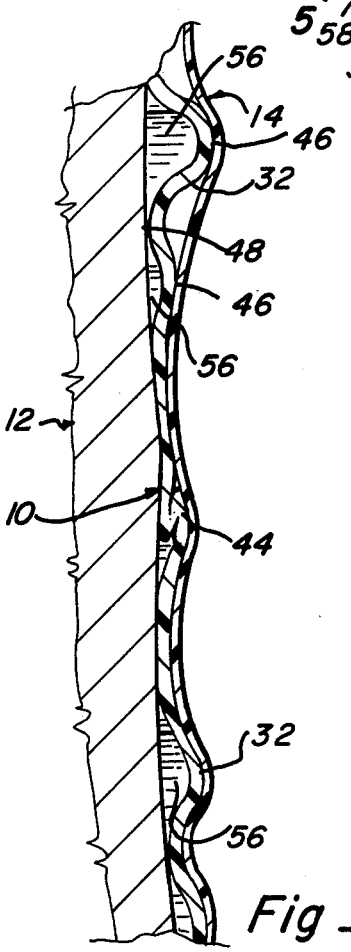
FIG. 4 is a fragmentary section to a greatly enlarged scale taken along line 4—4 of FIG. 3 showing how the pleats in the skirt fold and allow the shield to draw in tight against the meat when forced thereagainst by the collapsing bag.

Redirecting the attention for the moment to FIGS. 1, 7, 8 and 9 of the drawings where the shield is most clearly revealed, it will be seen to comprise a single sheet of pliable, preferably at least semitransparent, plastic that is vacuum molded or otherwise shaped to provide an undulate generally rectangular lid-forming member 30 bordered on all four sides by a marginal skirt 32. The undulate surface is made up of minor and major longitudinally-extending humps 34 and 36, respectively, separated from one another by a trough or valley 38. All four corners and edges separating the lid-forming portion 30 from the skirt 32 are generously rounded as shown. In particular form illustrated, the lower edge of the skirt is trimmed to leave an outturned scalloped flange 40 having divisions 42 between the elements thereof that coincide with pleats 44 in the skirt and permit the latter to open and close so as to accommodate differences in the length and width of the meat cut 12. Between each of these pleats 44 is a series of corrugations 46 which parallel one another and run generally perpendicular to the lid-forming portion 30 thereabove. While the major expansion and contraction of the skirt 32 to accommodate oversize and undersize cuts is borne by the pleats 44, the corrugations 46 function to a lesser extent in accordian-like fashion to permit the skirt to expand and contract lengthwise has been illustrated in FIG. 4 to an admittedly exaggerated degree. In fact, the size of some cuts is so uniform that pleats 44 can be eliminated and the minimal expansion or contraction necessary to accommodate the oversize and undersize cuts borne exclusively by the corrugations or folds in the skirt itself.

Before proceeding further with a detailed description of the shield itself it would perhaps, be helpful to explore in greater depth the packaging of the cut and the areas of greatest potential stress for which purpose reference will once again be made to FIGS. 1, 2 and 3. The exposed bone ends 16 on the truncated front surface 22 of the cut, while somewhat prone to puncture the package, are not nearly as critical as the upwardly-facing ones on upturned surface 24. There are several reasons for this among which is the fact that the meat when finally packaged is most often boxed and stored resting on its thick side 48 that lies immediately adjacent upturned truncated surface 24, i.e. in the attitude shown in FIG. 3. Accordingly, it becomes this heavy thick side of the meat where surfaces 24 and 48 are located that is subjected to the greatest abuse from outside objects that impinge thereagainst. To protect the package against these excesses, special attention is given to the formation of the major hump 36 that overlies the upturned surface 24. It is with respect to these features and the cooperating features adjacent thereto that reference will next be made to FIGS. 5, 6, 7, 8 and 9 where they are most clearly revealed.

Figure 5:
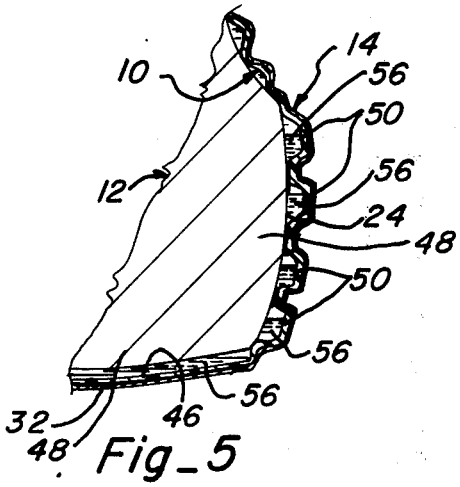
FIG. 5 is another fragmentary section to the same scale as FIG. 4 taken along line 5—5 of FIG. 3 which reveals the crush-resistant dome-like dimples covering the exposed bone ends in the lower corners.

The first of these special features are the dimples 50 formed in the corners of the major hump 36 and which are shown in FIG. 5. These dimples project above the surface of the sheet from which the shield is fabricated and they define highly crush-resistant dome-like elements that are most difficult to dent into the degree where the inside surface thereof comes into contact with either the soft tissue or the bone ends. Thus, they provide a highly crush-resistant area at those lower corners susceptible to the greatest impact damage during handling and storage. These dimples function to cushion the meat therebeneath from external impacts regardless of whether they are filled with fluid or not, however, under normal circumstances many, if not all of them, will be at least partially filled with the juices (purge) squeezed from the meat which provides an additional cushioning action that is most effective.

Figure 6:
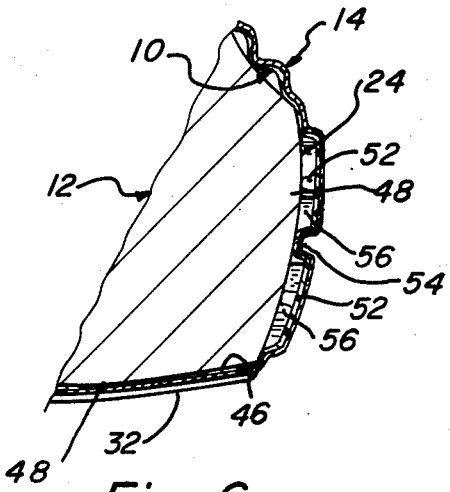
FIG. 6 is still another fragmentary section to approximately the same scale as FIGS. 4 and 5 taken along line 6—6 of FIG. 3 showing the fluid-filled pockets and channels in the critical areas overlying the exposed bone ends that cushion the package and render it highly puncture resistant from both the inside and outside.

Lying between these dimpled corner areas on the major hump 36 are parallel rows of individual capsule-shaped pockets 52 that are most clearly revealed in FIG. 6 to which detailed reference will now be made. These pockets rise above the surface of the sheet in the same manner as the dimples 50; however, in the particular form illustrated they are not as deep as the dimples. Also, they are more uniform in shape and several of them are normally arranged in end-to-end relation in each row although their size and arrangement is by no means critical. Actually, they constitute continuations of the corrugations 46 on the portion of skirt 32 that covers side 48 of the cut except that they are interrupted at intervals by dam-forming indentations 54 extending transversely thereof. The corrugations 46 in the skirt define canal-like channels that fill with fluid 56 and cushion end 48 upon which the cut will ultimately rest under normal conditions as shown in FIGS. 3, 5, and 6. The pockets 52, on the other hand, tend to trap the juices 56 squeezed from the adjacent soft tissue as the shield is forced tightly thereagainst by the collapsing bag 12 thus preventing a substantial portion of these fluids from settling all the way down into the bottom end of the package.

Figure 7:
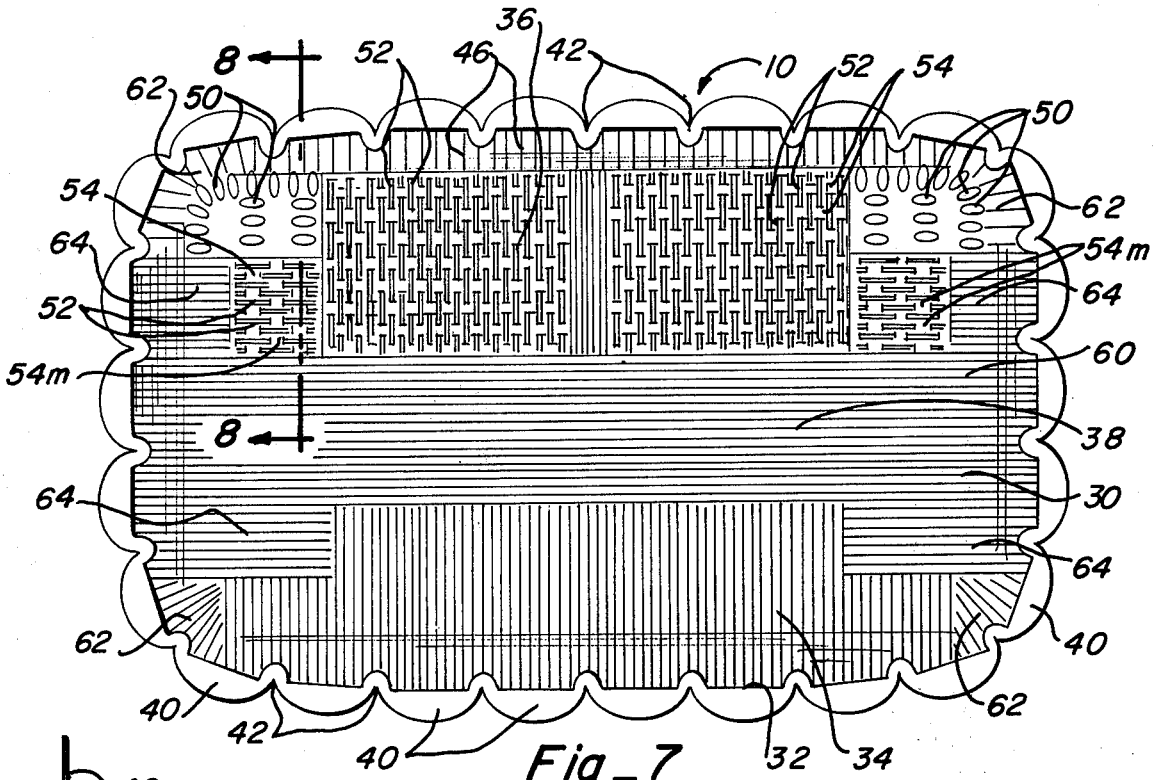
FIG. 7 is a top plan view to approximately the same scale as FIGS. 1 and 2 which shows the pleats together with the channels and pockets that cooperate to distribute the fluids in the meat and collect it where its cushioning effect is most needed.
Figure 8:
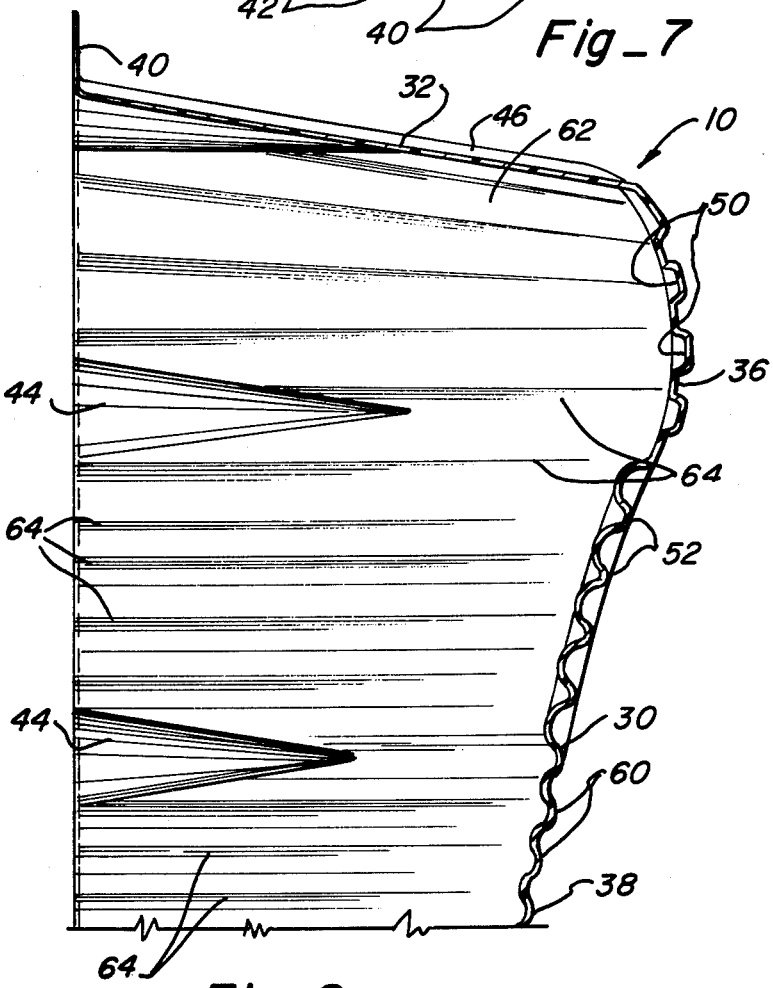
FIG. 8 is a fragmentary section to a greatly enlarged scale taken along line 8—8 of FIG. 7.
Figure 9:
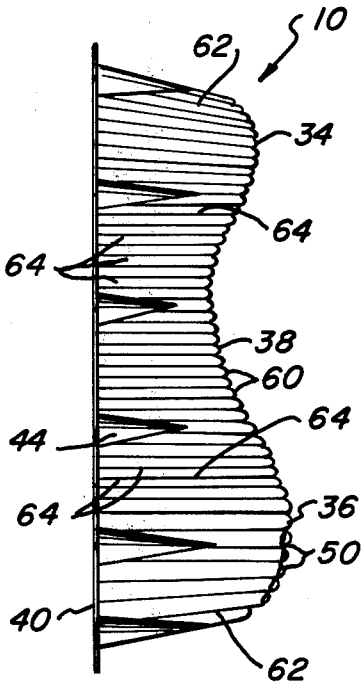
FIG 9 is an end elevation to essentially the same scale as FIG. 7.

Looking next at FIGS. 1, 2, 3, 7, 8 and 9, juices purged from the meat from underneath the minor hump 34 and the medial section 38 are also restricted somewhat in their gravitational flow toward the bottom of the package by the pockets 52 except in the center of the major hump 36 where no such pockets are found. Instead, in this area, uninterrupted channels 58 are formed and positioned to receive the fluids from the areas thereabove and deliver it to those corrugations 46 in the skirt that form continuations thereof. The corrugations 46 of the skirt that cover the end 22 of the cut continue on over onto the minor hump 34 terminating at the longitudinally extending corrugations 60 that extend lengthwise of the trough 38 as shown in FIGS. 1 and 7. These longitudinal corrugations 60 function to retard the flow of juices from the thin side of the cut down to the thick side when it is turned up to rest on the thick side as seen in FIG. 3. Corrugations 62 are provided in the corners of the skirt as well as in the ends, those on the ends having been identified by reference number 64 and shown in FIGS. 1, 7, 8 and 9. These end corrugations 64 extend over onto the top of the shield where they are interrupted at spaced intervals by dam-forming indentations 54M similar to those (54) separating the pockets 52 and for the same purpose, namely, to restrict the flow of juices squeezed from the soft tissue therebeneath.

Returning once again to FIG. 1, the shield is laid atop the cut of meat as shown and then the subassembly thus formed is placed in a heat sealable plastic bag 14. The downturned skirt 32 functions to keep the shield in place atop the cut while inserting the subassembly into the bag, this being a factor of considerable importance in that flat sheet-like materials without such a skirt do not stay in place and contribute to the high rate of leakers encountered in present day packaging methods. The corrugations 46, 62 and 64 along with pleats 44 in the skirt also cooperate with one another to permit the shield to stretch lengthwise about 1 inch and widthwise between a half and three-quarters of an inch to accommodate oversize cuts.

Once the meat cut and associated shield are housed inside the bag, the package assumes the general form shown in FIG. 2 preparatory to being evacuated. There is little danger of the bag being punctured at this stage as the shield covers all the exposed bone ends and the meat cut lies on the soft tissue on its convex undersurface. Also, the bag is oversize and fits quite loosely over the subassembly.

Next with reference to FIG. 3 it will be seen that following evacuation of the air from inside the bag, it collapses against the shield which is quite pliable and forces the latter down tightly against the surface of the meat cut as shown. In so doing, the scalloped flange 40 bordering the free edge of the skirt is folded down flat against the soft tissue. At the same time, the areas of the shield in contact with the soft tissue squeeze the purge therefrom and retain it in the dimples 50, pockets 52 and even some of the blind-ended channels formed by the corrugations even after the package is turned up to rest on its thick edge. The pleats 44 also fold and close to allow the skirt to fit snugly against the adjacent soft tissue therebeneath or, in the absence of these pleats, some stretching can be accommodated by the corrugations alone. The skirt can, of course, merely fold to accommodate an undersize cut.

The dimples at the ends of the major hump provide the dome-like crush resistant protective coverings for the most vulnerable portions of the package whether filled with purge or not, but especially if this is the case. The same is true of the pockets 52 but to a somewhat lesser extent as these capsule-shaped features do not possess the inherent crush resistance of the dimples although they do have some. When filled with fluid, however, and they usually are in normal use, they provide an excellent cushioning effect over the exposed bone ends on upturned surface 24. The purge that settles in corrugations 46 within the portion of the skirt 32 covering surface 48 is most significant from a cushioning standpoint as this is the side of the package upon which it normally rests when boxed, shipped and stored. Ordinarily, this area of the package is completely filled with fluid.

Once the shield is drawn down tight against the meat cut, it bcomes completely transparent and clearly reveals the meat therebeneath even though the plastic sheeting from which it is formed is cloudy or semi-opaque to start with. Thus, contrary to the prior art wax-impregnated cloth shields which hide the meat, that which forms the subject matter of the instant invention cooperates with the bag to reveal same. It should also be noted that the bulk of the resulting package is little, if any, greater than it is with conventional packaging techniques and it is somewhat lighter in weight due to the shield being lighter than the wax-impregnated cloth cover ordinarily used.

Figure 10:
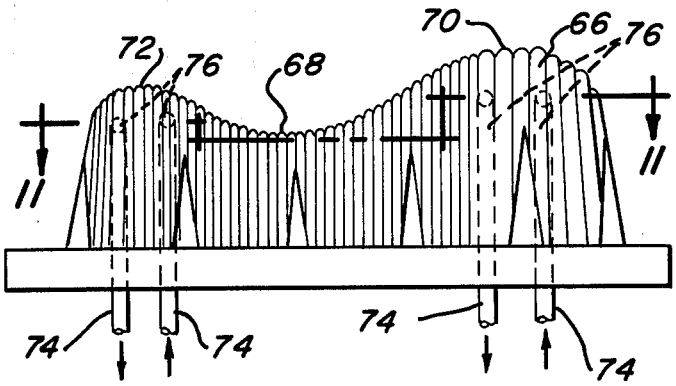
FIG. 10 is an end elevation of the mold showing the cooling system by means of which selected areas thereof are cooled to chill the sheet and maintain it essentially the same thickness in the areas of greatest potential stress while the uncooled areas are allowed to draw thin and become pliable; and, FIG. 11 is a section taken along line 11—11 of FIG. 10.
Figure 11:
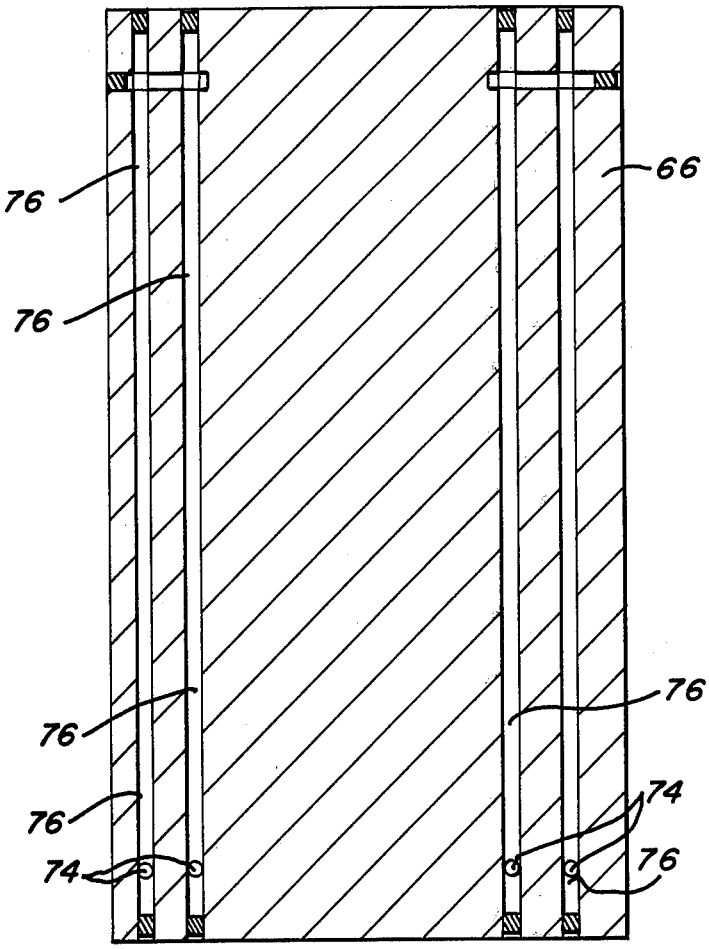

Next, the novel method of forming the shield will be set forth in detail and reference will be made to FIGS. 10 and 11 for this purpose. The simplest and least expensive technique for molding the shield is that of vacuum forming. In accordance with customary practice in the vacuum-forming art, a sheet of heat softenable plastic material is fastened in a suitable frame overlying a mold. After heating the plastic to the point where it becomes soft and stretchable, it is sucked down over the mold by evacuating the air therebeneath through appropriately positioned passages in the mold and mold bed atop which it rests. FIGS. 10 and 11 illustrate such a mold and it has been identified by reference numeral 66. No attempt has been made in FIGS. 10 and 11 to show the passages through which the air is withdrawn as their contruction and location are well within the skill of the ordinary artisan and, for this reason, such features form no part of the instant invention.

Now, in accordance with conventional vacuum-forming methods, the pre-warmed plastic sheet from which the shield is to be formed would be sucked down atop a mold shaped like mold 66 whereupon it would stretch to form the marginal skirt 32 and associated flange 40 as well as the portion covering the concave trough 68 lying between the major and minor humps 70 and 72 of the mold. Unfortunately, when this occurs, the areas of the sheet in which the greatest stretching occurs lie atop the humps and especially at opposite ends thereof where the upper outside corners are found. As previously noted, these are the very areas of the shield which overlie the exposed bone ends and are, therefore, the most likely to be punctured.

Accordingly, the conventional vacuum-forming techniques are unsuited for use in molding the shield of the present invention as they result in the thinnest and, therefore, the weakest parts of the shield being located precisely where the greatest strength is needed. It has been found, however, that the foregoing objectionable features of the conventional vacuum-forming methods can be eliminated by the simple, yet unobvious, expedient of selectively cooling the hump region 70 and 72 of the mold 66 so that the plastic sheeting overlying these areas tends to maintain its original thickness while those areas bordering same that overlie the soft tissue are allowed to stretch and elongate to the extent necessary to form skirt 32, flange 40 and trough 38. This is accomplished by circulating a coolant through cooling tubes 74 that connect into bored passages 76 running beneath the humps 70 and 72 closely adjacent the surface. Such selective cooling provides the shield vacuum formed on mold 66 with the greatest thickness and strength in those portions which over the exposed bone ends that are the most likely to be punctured. Moreover, the area of maximum stretch is the skirt 32 and associated scalloped flange 40, both of which are subject to the greatest degree of deformation and, appropriately are the thinnest and most pliable.

What is claimed is:

1. In combination: a cut of meat of the type having one or more rows of exposed bone ends and a concave surface adjacent thereto; an air-tight collapsible bag adapted to receive said meat cut and form a vacuum pack therefor upon being evacuated and sealed; and a sheet of pliable heat-formable puncture-resistant and fluid-impervious plastic preformed to provide at least one hump positioned and adapted to overlie a row of said exposed bone ends defining a protective cover therefor, a troughed section alongside said hump for covering said concave surface, and a skirt bordering said hump and troughed section cooperating therewith and with said meat cut to maintain said cut and cover in assembled relation while being placed in the bag and the latter evacuated and sealed.

2. The combination of claim 1 wherein the cover includes a second hump paralleling said one hump located on the opposite side of the troughed section in position to overlie a second row of exposed bone ends comprising the other ends of the first set.

3. The combination of claim 1 wherein the skirt is provided with a plurality of pleats spaced therearound and adapted to expand or fold so as to accommodate both oversize and undersize cuts.

4. The combination of claim 1 wherein the thickness of the sheet within the hump is substantially greater than in the troughed section or along the skirt.

5. The combination of claim 1 wherein a plurality of dome-like crush-resistant dimples are molded into the areas at opposite ends of the hump.

6. The combination of claim 1 wherein pockets are formed in those portions overlying the exposed bone ends effective to receive and trap fluids from the meat when forced tightly thereagainst by the collapsing bag. pg,20

7. The combination of claim 1 wherein the skirt is corrugated to define channels effective to evacuate air from between said cover and concave surface upon collapse of the bag thereagainst.

8. The combination of claim 1 wherein the plastic sheet is semitransparent and cooperates with the meat upon being pressed tightly thereagainst to become fully transparent.

9. The combination of claim 1 wherein the skirt is corrugated, said corrugations defining channels effective to deliver juices squeezed from the meat to the hump upon collapse of the bag thereagainst, the juices collected in said hump cooperating therewith to define a shock-resistant cushion interposed between the exposed bone ends and bag.

10. The combination of claim 9 wherein said corrugations also define channels effective to evacuate air from between said cover and concave surface upon collapse of the bag thereagainst.

* * * * *